US008979017B2

(12) United States Patent
Zapata

(10) Patent No.: US 8,979,017 B2
(45) **Date of Patent: *Mar. 17, 2015**

(54) DEVICE AND SYSTEM FOR PROPELLING A PASSENGER

(71) Applicant: Personal Water Craft Product, Le Rove (FR)

(72) Inventor: Frankie Zapata, Le Rove (FR)

(73) Assignee: Zapata Holding, Le Rove (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/037,593

(22) Filed: Sep. 26, 2013

(65) Prior Publication Data

US 2014/0158832 A1 Jun. 12, 2014

Related U.S. Application Data

(63) Continuation of application No. 13/648,418, filed on Oct. 10, 2012, now Pat. No. 8,608,104, which is a continuation of application No. 13/556,720, filed on Jul. 24, 2012, now Pat. No. 8,336,805, and a continuation of application No. PCT/FR2012/050875, filed on Apr. 20, 2012.

(60) Provisional application No. 61/539,262, filed on Sep. 26, 2011.

(30) Foreign Application Priority Data

Sep. 19, 2011 (FR) ..... 11 58297

(51) Int. Cl.
*B64C 29/00* (2006.01)
*B64C 39/02* (2006.01)

(52) U.S. Cl.
CPC ..... *B64C 39/026* (2013.01); *B64C 29/00* (2013.01)
USPC ..... 244/23 A; 244/4 A; 244/23 C

(58) Field of Classification Search
USPC ..... 244/4 A, 4 R, 2, 12.5, 17.17, 52, 23 R, 244/23 A
See application file for complete search history.

(56) References Cited

U.S. PATENT DOCUMENTS

| | | | | | |
|---|---|---|---|---|---|
| 2,417,896 | A | * | 3/1947 | Zimmerman | 244/17.15 |
| 2,943,816 | A | * | 7/1960 | Hiller, Jr | 244/23 R |
| 2,953,321 | A | * | 9/1960 | Robertson et al. | 244/23 C |
| 3,021,095 | A | * | 2/1962 | Moore | 244/4 A |
| 3,023,980 | A | | 3/1962 | Martin et al. | |
| 3,107,069 | A | * | 10/1963 | Draim | 244/4 A |
| 3,243,144 | A | * | 3/1966 | Hulbert et al. | 244/4 A |
| 3,277,858 | A | * | 10/1966 | Athey | 440/43 |
| 3,381,917 | A | * | 5/1968 | Moore et al. | 244/4 A |
| 3,416,753 | A | * | 12/1968 | Hulbert | 244/4 A |
| 3,443,775 | A | | 5/1969 | Williams | |
| 3,474,987 | A | * | 10/1969 | Meditz | 244/4 R |
| RE26,756 | E | * | 1/1970 | Moore et al. | 244/4 R |

(Continued)

*Primary Examiner* — Christopher P Ellis
*Assistant Examiner* — Medhat Badawi
(74) *Attorney, Agent, or Firm* — Buchanan Ingersoll & Rooney PC

(57) ABSTRACT

The invention relates to a propulsion device (10) comprising a body (11) arranged for receiving a passenger (1) and engaging with a thrust unit (12*a*, 12*b*, 13*a*, 13*b*) supplied with a pressurized fluid from a compression station. The arrangement of such a device offers great freedom of movement through the air or under the surface of a fluid. The invention also relates to a propulsion system in which the compression station can be remote in the form of a motorized marine vehicle.

13 Claims, 2 Drawing Sheets

(56) References Cited

U.S. PATENT DOCUMENTS

| | | | | |
|---|---|---|---|---|
| 3,570,785 | A | 3/1971 | Croft et al. | |
| 3,580,528 | A * | 5/1971 | Boyce et al. | 244/171.1 |
| 3,662,973 | A * | 5/1972 | Paine et al. | 244/23 A |
| 4,040,577 | A * | 8/1977 | Moore | 244/4 A |
| 4,447,024 | A * | 5/1984 | Williams | 244/23 A |
| 4,813,634 | A * | 3/1989 | Zuck | 244/122 A |
| 5,779,188 | A | 7/1998 | Frick | |
| 6,488,232 | B2 | 12/2002 | Moshier | |
| 6,874,728 | B2 * | 4/2005 | Lau | 244/4 A |
| 6,951,322 | B2 * | 10/2005 | Klima | 244/138 R |
| 6,969,027 | B2 * | 11/2005 | Ishiba | 244/23 C |
| 7,182,295 | B2 * | 2/2007 | Redmond | 244/158.1 |
| 7,249,732 | B2 * | 7/2007 | Sanders et al. | 244/23 A |
| 7,258,301 | B2 | 8/2007 | Li | |
| 7,581,608 | B2 * | 9/2009 | St. Louis | 180/116 |
| 8,336,805 | B1 * | 12/2012 | Zapata | 244/4 A |
| 8,608,104 | B2 * | 12/2013 | Zapata | 244/4 A |
| 2002/0113165 | A1 * | 8/2002 | Moshier | 244/4 A |
| 2008/0014811 | A1 | 1/2008 | Zeyger | |
| 2008/0142644 | A1 * | 6/2008 | O'Roark | 244/4 A |
| 2010/0200702 | A1 * | 8/2010 | Li | 244/4 A |
| 2013/0068895 | A1 * | 3/2013 | Zapata | 244/23 A |

* cited by examiner

DEVICE AND SYSTEM FOR PROPELLING A PASSENGER

CROSS REFERENCE TO RELATED APPLICATIONS

This application is a continuation application of Ser. No. 13/648,418, filed Oct. 10, 2012, which is a continuation of Ser. No. 13/556,720, filed Jul. 24, 2012, now U.S. Pat. No. 8,336,805, issued Dec. 25, 2012, which is a non-provisional application of Ser. No. 61/539,262, filed Sep. 26, 2011, and a continuation of PCT/FR2012/050875, filed Apr. 20, 2012.

FIELD

The invention relates to a device and a system for propelling a passenger in order for the latter to be able to move through the air or within a fluid with very large freedom of movement thanks to the agility and the physique of the passenger.

The invention also provides for the system to be very simple to implement and accessible to as many people as possible.

BACKGROUND

Moving through space has always been one of the main dreams of mankind. Many machines have been produced, each more sophisticated than the last, which aim to achieve this dream with greater or lesser success.

Thus, in order to attempt to move with ease through environments as diverse as the surface of water or in contact with a sometimes hostile environment, a propulsion device such as described in the 1960s in U.S. Pat. No. 3,243,144 or U.S. Pat. No. 3,381,917 comprises a body in the form of a harness or a seat on which or in which a passenger can be positioned. Such a body engages with a thrust unit in particular in the form of a pair of nozzles for ejecting a fluid under pressure and thus to generate a thrust force. In order to simplify the flight of the passenger and to reduce the physical effort thereof, the nozzles are arranged above the centre of gravity of the body-passenger assembly, specifically at the height of the passenger's shoulders. The unit also includes a fluid-compression station supplied with flammable liquids or gases and positioned on the back of the passenger. Said station is capable of supplying enough thrust to cause the passenger to take off, transformed into a type of human rocket. The low operating range coupled with the dangerousness of such devices have caused them to remain relatively confidential.

More recently, a device such as describes in U.S. Pat. No. 7,258,301 and US patent application 2008/0014811 A1 draws inspiration from said teaching, adapting it to reduce the dangerousness of the system. The compression station in this case is remote and generally dedicated. Furthermore, the pressurised fluid is water compressed by said station, drawing inspiration in this regard in particular from experiments aiming to use compressed water to reduce the physical effort of a deep-sea diver, as suggested in U.S. Pat. No. 3,277,858. U.S. Pat. No. 7,258,301 and US patent application 2008/0014811 A1 thus propose an airborne propulsion device that is similar to its predecessor, adapted such that pressurised water is transported from a remote compression station by means of a supply channel such as a fire hose. The configuration of the nozzles as well as the means that makes it possible to direct said nozzles in order to determine the trajectory of the device are deliberately kept in order to maintain certain ease of piloting for the passenger. However, in particular the take-off phase requires the passenger to be in an initial standing position, with the feet on a solid surface. The physical effort of the passenger to move, reduced to the simplest expression thereof, is detrimental to the freedom and the variety of movements on the surface of the water or under the surface thereof. Furthermore, such a "device+station" system in accordance with U.S. Pat. No. 7,258,301 is expensive due to the design of the device comprising hinged nozzles, and to the design of a dedicated compression station. The fact of being able to move through space has an intrinsic recreational side. However, the configuration of the nozzles located above the centre of gravity of the device gives the passenger the impression of hanging by the shoulders from a virtual crane hook, and thus deprives the passenger of many sensations: falls, improvised or acrobatic style figures. Furthermore, the variety of directions and movements is limited. It is not easy, for example, to move "crabwise" with a known device, or to change instantly from a straight trajectory on the surface of the water to a diving phase followed by multiple movements under the surface of the water.

SUMMARY

The invention offers a response to all the disadvantages raised by the known solutions. The invention consists mainly of providing a device in which the design implies a break with the prior art. Such a device comprises mainly a substantially planar platform on which one or more passengers can be positioned. The take-off and the movements are generated by a thrust force supplied by a set of at least three nozzles, two of which are free and intended for being held by one of the passengers, said nozzles all being arranged such as to be positioned below the centre of gravity of the "device-passengers" assembly. It is therefore thanks to their physique and their agility that the passengers of said innovative device can control the thrust of the device and perform movements and acrobatics with very large freedom and an unrivalled recreational side.

In order to offer such sensations to a large number of users, the invention provides the possibility of using known motorised water vehicles (MWV) as a remote compression station. The invention does not require the design of dedicated compression stations.

Among the many advantages of the invention, it can be mentioned that the invention makes it possible:

- to make available to users a highly recreational device which, after learning, becomes easy to use, offering a broad range of applications;
- to minimise to the simplest expression thereof the elements required for manufacturing the propulsion device;
- to use motorised water vehicles or land vehicles to supply the pressurised fluid required for the thrust of the device;
- to offer the capacity to take-off or dive from any completely or partially submerged conditions, from dry land, etc.;
- to provide recreational (jousting, acrobatics, etc.) as well as civil or military security applications.

For this purpose, the invention provides a propulsion device comprising a body arranged for receiving a passenger and engaging with a thrust device supplied with a pressurised fluid. In order to make use of the physique and agility of said passenger, the body comprises a substantially planar platform which has a bottom surface and a top surface on which a passenger can be positioned. The invention also provides for the thrust unit to consist of:

- at least one main nozzle engaging with the bottom surface of the platform and being positioned according to an axis substantially perpendicular to said bottom surface;

two free secondary nozzles arranged to be held by the passenger during nominal use of the device below the centre of gravity of the "device-passenger" assembly.

In order to improve the handling of the device according to the invention, the nozzles can be advantageously moved forwards in order for the at least one main nozzle to provide the majority of the thrust force to the detriment of the secondary nozzles.

In order to supply the device with pressurised fluid, in one embodiment, a propulsion device according to the invention can comprise a means for collecting and distributing the pressurised fluid to the nozzles, a means arranged for connecting a fluid supply channel to the device.

According to said embodiment, to avoid straining said channel according to the movements of the device, the collection and distribution means can comprise a base to which said supply channel is connected, enabling free rotation of said supply channel about an axis substantially parallel to that of the channel.

Similarly, said collection and distribution means can comprise an arm arranged for engaging with one of the at least one main nozzles and supply same with a pressurised fluid collected from the base, while enabling free rotation about an axis substantially parallel to that of said arm.

In order to make it easier to balance the passenger on the platform of a device according to the invention, the latter can comprise a means for ensuring that the passenger is maintained on the top surface of the platform.

Similarly, in order to help the passenger to control the secondary nozzles, the invention provides that a device can comprise a means for restraining the secondary nozzles on the passenger's forearm.

In order for the passenger to have better control of the propulsion device and to perform certain trajectory changes, a propulsion device according to the invention can comprise a means for controlling the fluid-compression power of a compression station supplying the pressurised fluid.

In order to provide recreational applications—such as jousting or spraying—or applications linked, for example, with fire fighting, a device may also comprise a means engaging with the platform or the passenger such as to spray a second pressurised fluid.

In order to protect the elements of the device positioned under the bottom surface of the platform when the device is in contact with the ground or with any other solid environment or to be able to influence the buoyancy of the device, the latter can also comprise a projecting means engaging with the platform and being arranged to prevent an impact or direct contact between the bottom surface of the platform and the non-fluid near environment of said bottom surface.

In order to offer greater freedom of service for the passenger of a propulsion device, the device can comprise a means for controlling the fluid-compression power of a compression station supplying the pressurised fluid.

According to a second subject matter, the invention provides a propulsion system comprising a propulsion device according to the invention engaging with a remote compression station.

A system according to the invention can comprise a supply channel in order for the station to supply said pressurised fluid to said device via said supply channel.

According to embodiments of the propulsion device when the latter comprises a means for controlling the fluid compression power, a system according to the invention can comprise a communication means for transmitting a command output by the means for piloting the device to a means for regulating the compression pressure of a compression station thus adapted.

Other characteristics and advantages will appear more clearly when reading the following description and referring to the appended drawings.

DETAILED DESCRIPTION

Figure 1:
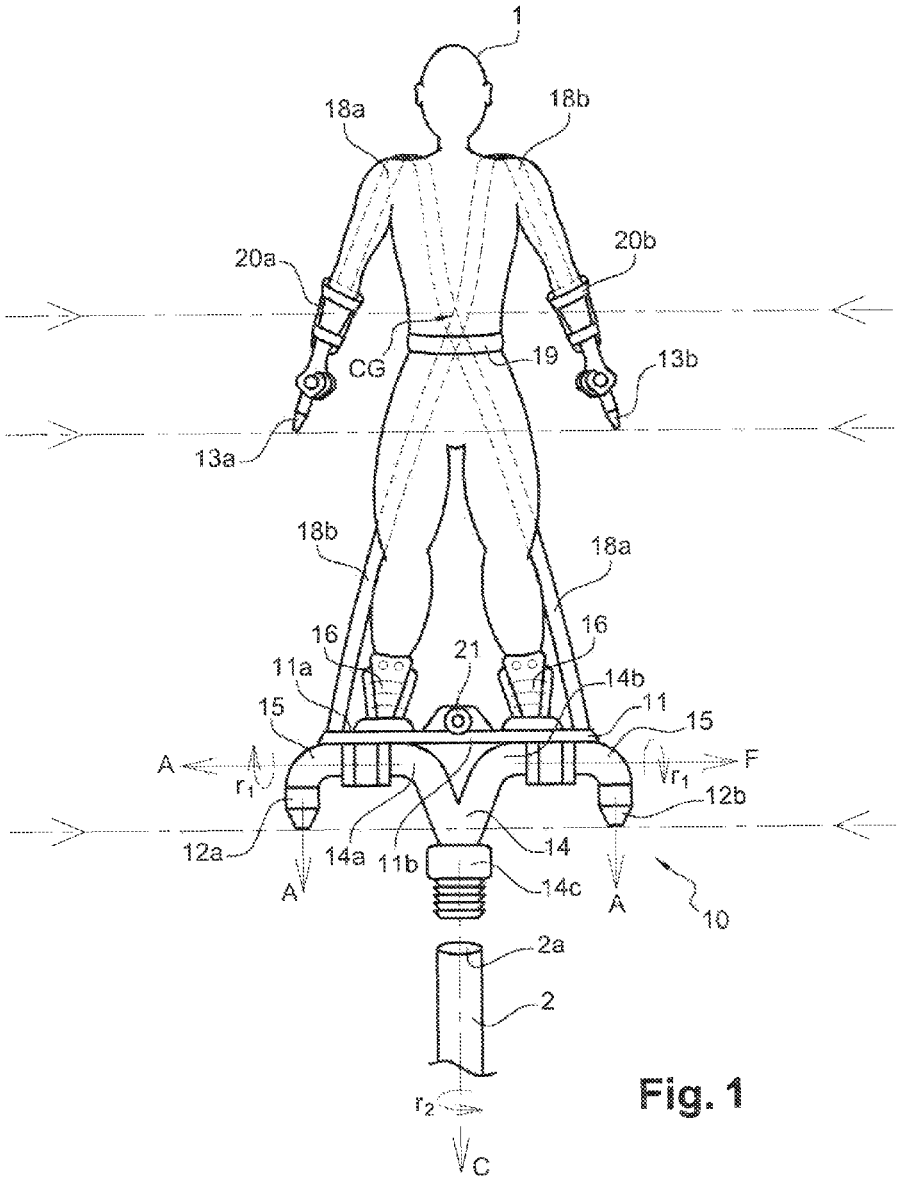
FIG. 1 shows a propulsion device according to the present invention.

FIG. 1 shows an embodiment of a propulsion device 10 according to the invention. Said device comprises a main body in the form of a substantially planar platform 11. Said platform comprises a top surface 11*a* on which a passenger 1 can be positioned. According to the size of the platform and the power of the device, the invention provides for a plurality of passengers optionally to be able to be positioned simultaneously on the top surface 11*a* of said platform 11. The platform can be advantageously made from one material or a plurality of materials having, alone or in combination, enough rigidity to withstand the weight of the passenger or passengers and thus to prevent excessive warping. It may be preferable for said platform to be made of one material in order to determine the buoyancy of the device when the latter is submerged. According to the embodiments, the platform can thus have one or more cavities filled with air or a vacuum in order to improve the buoyancy thereof. As an alternative, it may be preferable not to include vacuum or cavities or to include a ballast in order to make it easier to move under the surface of a fluid. Such a platform can comprise one or more elements engaging with one another or separate.

The propulsion device described in connection with FIG. 1 comprises a thrust group engaging with the platform 11.

For the purpose of the invention and in the present document, the term "nozzle" has been used to define a profiled duct element for increasing the speed of a flowing fluid. The term "jet pipe" could also be used to describe such an element. This speed increase of the fluid is mainly caused by a difference in cross-section between the intake and the outlet of the element, the outlet having a smaller cross-section than the intake.

According to FIG. 1, such a unit consists of a pair of main nozzles 12*a* and 12*b* attached to the bottom surface 11*b* of the platform 11. As an alternative, a single main nozzle attached substantially at the centre of the bottom surface 11*b* of the platform may be preferred over the pair 12*a*, 12*b*. The recreational nature of the use of the device by a passenger can thus be increased. In general terms, the invention is not limited to the number of main nozzles located under the bottom surface 11*b* of the platform 11. The thrust unit thus comprises at least one main nozzle engaging with said bottom surface.

Said at least one main nozzle 12*a*, 12*b* is attached by any means to the platform, with no degree of freedom. In order to assist the take-off of the device, the direction of every main nozzle advantageously follows an axis A preferably substantially perpendicular to the bottom surface of the platform such that a main nozzle expels a pressurised fluid from near the bottom surface 11*b* of the platform 11 and away from same. In order to improve the handling of the device, the thrust unit of a device according to the invention can also comprise two secondary nozzles 13*a* and 13*b*. The latter are free and respectively intended for being held by the forearms or the hands of a passenger 1. The "platform, thrust unit and passenger(s)" assembly has a centre of gravity CG when said assembly is straightened out vertically such as indicated in FIG. 1. Unlike in the prior art, in which the nozzles of the thrust unit are necessarily positioned above said centre of gravity CG in order to minimise the physical effort of the passenger and to simplify the movements thereof, the main and secondary nozzles of the thrust unit of a device 10 according to the invention are positioned below said centre of gravity CG. A passenger of such a device 10 has the task of positioning and directing the secondary nozzles 13*a* and 13*b* with his or her hands and arms and the main nozzle or nozzles 12*a* and 12*b* by playing with the inclination of the platform using his or her feet, legs, pelvis and torso in order to pilot the propulsion device. The agility of the passenger as well as his or her physical fitness thus maximise the sensations provided and make it possible to perform movements, trajectories and acrobatic figures, whether intended or accidental.

In order to supply sufficient thrust force and enable take-off and movement, the device 10 also comprises a means for collecting and distributing a pressurised fluid (for example water) to the main and secondary nozzles. Such a fluid is preferably transported by a flexible supply channel 2 from a remote compression station—not shown in FIG. 1. Such a supply channel can be manufactured from a fire hose or from any other material that offers the necessary strength against the pressure exerted by the pressurised fluid. It may be preferable, advantageously, to use a supply channel with a diameter of substantially 110 millimeters. An excessively small or large diameter would result in a considerable loss of thrust force in respect of the compression capacity of the compression station. A collector 14 can thus comprise a base 14*c* to which an end piece 2*a* of a supply channel 2 connects, for example by means of a flute adapted such as to receive said channel 2. The diameter of said base 14*c* must be adapted to the diameter of the end piece 2*a* of the supply channel 2. According to FIG. 1, the collector 14 can be approximately T-shaped in order to collect the pressurised fluid from the base 14*c* and to distribute same via arms 14*a* and 14*b* to the main nozzles 12*a* and 12*b*. The collector 14 can be connected to the main nozzles rigidly or via an optional linking elbow 15 in order to direct the main nozzles according to an axis A substantially perpendicular to the bottom surface 11*b* of the platform 11. The arms can, as an alternative, be connected to said main nozzles—via the optional elbow 15—by a knuckle joint on the arms 14*a* and 14*b*. Such an arrangement enables free rotation r1 according to an axis F substantially parallel to the arms 14*a* and 14*b* of the collector 14. Thus, said collector can describe an almost free rotation r1 about said axis F, modulo the abutment represented by the bottom surface 11*b* of the platform 11 during an excessive inclination thereof. A relative rotation r1 of the collector about the axis F with respect to the plane of the bottom surface of the platform 11, after the collector links with the supply channel 2, does not lead to the rotation of the platform 11. Similarly, the invention provides for the end piece 2*a* of the supply channel 2 advantageously to be able to engage with the collector 14 at the base thereof 14*c* via a knuckle joint in order to enable free rotation r2 about an axis C substantially parallel to the channel 2. The device can thus swivel freely about said axis C without causing loops or excessive strain on the supply channel 2.

The T-shaped configuration—described as a preferred example in relation to FIG. 1—of the collector 14, comprising a base 14*c* and two diametrically opposed arms 14*a* and 14*b*, can obviously be different in the case of a device 10 which only has, for example, a single main nozzle. The collector 14 in this case would be configured as an elbow, like a "Γ", in order to collect—from a base 14*c*—and supply—via an arm 14*a*—the pressurised fluid from the supply channel 2 towards the main nozzle by means of an optional linking elbow 15 engaging with the arm of the collector as well as with the main nozzle. Advantageously, knuckle joints at the base 14*c* and the single arm 14*a* of the collector 14 are advantageously preferred for the reasons stated above.

In order to distribute the pressurised fluid to the secondary nozzles 13*a* and 13*b*, the invention provides, as an example and as indicated in FIG. 1, for secondary channels 18*a* and 18*b*—in the advantageous form of flexible pipes—to supply said pressurised fluid from the collector 14 to the secondary nozzles. In order not to disturb the passenger 1, said secondary nozzles can be guided along the back until the shoulders by using supporting means 19 (straps, harness, etc.). The invention provides for the device to offer a passenger the possibility of using a means for restraining the secondary nozzles on the forearms. Thus, in connection with FIG. 1, an assembly 20*a* and 20*b* of elements comprising a body for engaging with a forearm and a secondary nozzle and/or a secondary channel supplying said secondary nozzle can be attached by means of straps or any other type of attachment to each forearm of the passenger 1. It is easier for the passenger to hold a secondary nozzle.

The invention furthermore provides for the platform 11 to be able to comprise a means for maintaining a passenger on the top surface 11*a* of said platform. Thus, according to the preferred position of a passenger on the platform of a device according to the invention, said maintaining means can consist—as shown in FIG. 1—of a pair of shoes or boots with a binding such as that which is used, for example, when practising wakeboard. Other types of maintaining means may be preferred according to whether it is desirable to assist the passenger in a position with bent legs, kneeling or even sitting.

In order to assist the take-off and, in general terms, the use of a device according to the invention, the main nozzle or nozzles as well as the secondary nozzles may be arranged such that the thrust unit thus formed supplies the majority of the thrust force thereof from the main nozzle or nozzles to the detriment of the secondary nozzles. For this purpose, the configuration of the nozzles (cross-sections of the respective intakes and outlets of said nozzles) may be selected in order preferably to supply around 80% of the thrust force from the main nozzle or nozzles. Thus, as an example, a main nozzle can be manufactured with respective intake and outlet cross-sections of substantially 50 and 40 millimeters in diameter and a secondary nozzle can be manufactured with respective intake and outlet cross-sections of substantially 50 and 25 millimeters in diameter. According to said preferred embodiment, a secondary channel 18*a* and 18*b* may have a cross-section of around 40 millimeters in diameter. A collector 14 may, in turn, have a cross-section of 120 millimeters in diameter near the base thereof and a cross-section of 80 millimeters in diameter on an arm. The cross-section of an optional linking elbow 15 between a main nozzle and an arm of the collector may advantageously adapt the respective cross-sections of the arm and the intake of the nozzle. Any other configuration of the thrust unit may be selected in order to adapt the distribution of the thrust force between the main and secondary nozzles.

Figure 2:
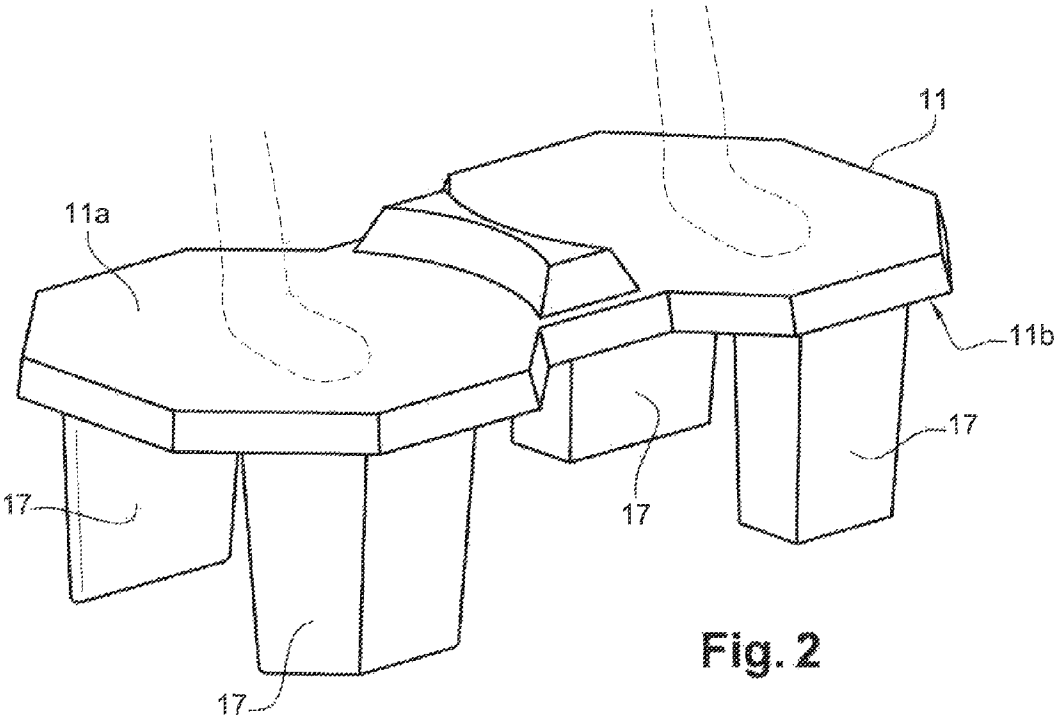
FIG. 2 illustrates an alternative embodiment of a platform of a propulsion device according to the present invention.

FIG. 2 describes a preferred embodiment of a platform 11 for a propulsion device according to the invention. Such a substantially planar platform 11 comprises—on the top surface thereof 11*a*—two spaces for respectively receiving the feet of a passenger, shown as dotted lines. Such a platform 11 is arranged such that the bottom surface 11*b* thereof engages with a projecting means 17 in turn arranged to offer protection for the elements—not shown in FIG. 2—of the device located under the bottom surface 11*b* of the platform 11, in a non-exhaustive manner: the main nozzle or nozzles, the means for collecting and distributing a pressurised fluid. Such a means 17 can thus form supporting points and constitute a protective cage for said elements. Any untimely impact or other direct contact between said elements and the immediate non-fluid environment thereof can thus be prevented, in particular during take-off or landing from dry land, or even when landing on water from shallow water.

The selection of the material or materials used for manufacturing the projecting means 17 can be determined by the required level of impact protection, the resistance to the weight exerted by the passenger or passengers on the platform during the take-off, landing or water-landing phases. The projecting means 17 can also interact with the sought buoyancy of the device according to the structure and configuration thereof.

A passenger of a propulsion device according to the invention can perform a presently unrivalled number of movements (in the air, under the surface of an aquatic medium, etc.). It can be mentioned that take-off can be carried out—when pressurised fluid is supplied to said device—if the passenger holds the secondary nozzles with his or her arms stretched towards the rear of his or her body and his or her back arched. A dive can, for example, be controlled by said passenger by curving his or her body with his or her head towards the front, etc.

In order to ensure easy piloting for the passenger and to grant an increased range of action, the invention provides for a propulsion device to be able also to comprise a means for controlling the power of the compression station. Thus, when receiving an order supplied by said means and carried by an adapted fixed or wireless communication means, the station can modulate the compression power of the fluid it supplies to the propulsion device. The passenger can thus control, for example, the take-off, or even fine-tune the movements thereof by modulating the pressure of the fluid flowing through the supply circuit connecting same to the compression station.

Furthermore, according to the applications or uses of a propulsion device according to the invention, the latter can also comprise a means 15 (for example in the form of a nozzle) for spraying a pressurised fluid other than that used to move the device or derived from same. Said optional means advantageously engages with platform 11 or, alternatively, with the passenger (on a shoulder, at the waist, etc.). The purpose herein is to offer a civil security application such as fire-fighting, for example, or even for water games: spraying third parties, novel jousting in which the jet of the second fluid forms a non-solid lance, preventing the risk of injuries while maintaining its function of destabilising an adversary . . . .

A propulsion device according to the invention, for instance such as the device 10 described as an example in connection with FIGS. 1 and/or 2, can be supplied by any remote fluid-compression station as soon as the latter is capable of supplying a fluid with high enough pressure for the operation of the propulsion device. The latter can be dedicated to said use at the risk of increasing the overall cost of a propulsion system comprising a propulsion device according to the invention, a remote compression station and a supply channel engaging with said device and station in order to transport the pressurised fluid.

In order to reduce such cost, the invention also provides for the remote compression station to be able to be an apparatus which has a main original function other than supplying a pressurised fluid of a propulsion device. As an example, the invention provides for a land- or sea-based fire-fighter's vehicle to be used as a remote compression station if said vehicle has enough fluid compression capacity. It is therefore possible to make use of the natural fluid-compression capacity of a motorised water vehicle (MWV) such as, for example, the RUNABOUT MZR 2011 edition, manufactured by ZAPATA RACING.

Regardless of the compression station used, the invention provides for said station to be able to comprise a means for regulating the compression power from a remote control. Thus, the means for controlling the power of an optionally remote compression station of a propulsion device in accordance with the invention can be made to interact with said means for adjusting the power of a station thus adapted. By means of a communication means (fixed or wireless) for carrying a control signal issued by the propulsion device and sent towards the compression station, a passenger of said device can remotely control the power of the station and thus adapt the movements performed using the propulsion device.

Figure 3:
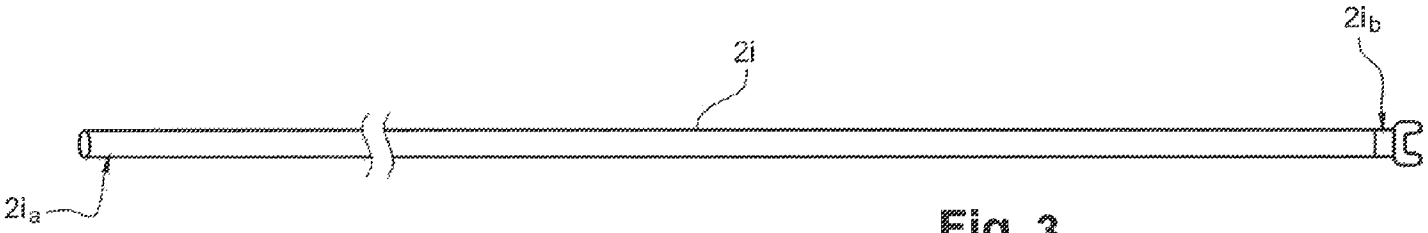
FIG. 3 depicts a modular embodiment of a pressurized fluid supply channel for a propulsion device according to the present invention.

As shown in FIG. 3, a supply channel 2—intended for being connected respectively to a propulsion device and to a remote compression station such as, for example an MWV—can be modular. Said channel can comprise a plurality of elements 2*i* that can be interconnected by means of couplings 2*ib* or free end pieces 2*ia*. Thus, the length of the supply channel 2 can vary according to the intended use thereof. It is also possible to connect, on demand, a propulsion device to which a first channel element 2*i*1 is already connected to a remote compression station comprising a first length of the supply channel 2*i*2 in order to supply a pressurised fluid. The packaging and transport of the elements of a propulsion system according the invention are thus easier.

A large number of recreational or civil and/or military applications are made possible with a propulsion system in accordance with the invention. For example, an MWV can be provided which carries a propulsion device and a supply channel in order for the driver of the MWV to be able, on demand, to become a passenger of the device.

The invention should not be limited by the cited examples of use.

Accessories for further improving the recreational nature or the operating conditions of such a system may also be provided: lighting, navigation means, etc.

The invention claimed is:

1. A propulsion device, comprising:

a platform having a bottom surface, and a top surface on which a passenger stands;

a thrust unit adapted to be supplied with a pressurized fluid, and including at least one nozzle engaging the bottom surface of the platform and oriented to provide thrust in a direction away from the position of a passenger standing on the top surface; and at least two protective projections that extend downwardly from the bottom surface of the platform to form supports that prevent contact between the nozzle of the thrust unit and non-fluid elements during take-off and landing of the propulsion device.

2. The propulsion device according to claim 1, wherein the protective projections are located forward and aft of the nozzle, relative to the direction in which a passenger faces when standing on the platform.

3. The propulsion device according to claim 1, comprising four protective projections respectively disposed in front of and behind the positions at which the feet of a passenger are located when standing on the platform.

4. The propulsion device according to claim 1, further comprising an attachment device to maintain the passenger on the top surface of the platform.

5. The propulsion device according to claim 4, wherein said attachment device comprises footwear and a binding for attaching the footwear to the top surface of the platform.

6. The propulsion device according to claim 1, further comprising a fluid collector and distributor that supplies pressurized fluid to the nozzle, and that is configured to connect a supply channel to the device.

7. The propulsion device according to claim 6, wherein the fluid collector and distributor comprises a base to which a supply channel is connected, enabling free rotation of the supply channel about an axis substantially parallel to that of the channel.

8. The propulsion device according to claim 7, wherein the fluid collector and distributor comprises an arm that engages with the nozzle to supply the nozzle with a pressurized fluid collected from the base and to allow free rotation about an axis substantially parallel to that of said arm.

9. The propulsion device according to claim 1, wherein the thrust unit includes a plurality of nozzles engaging the bottom surface of the platform, each of said plurality of nozzles being oriented to provide thrust in a direction away from the position of a passenger on the top surface.

10. A propulsion device, comprising:

a platform having a bottom surface, and a top surface on which a passenger stands;

a thrust unit adapted to be supplied with a pressurized fluid, and including a plurality of nozzles engaging the bottom surface of the platform, each of said plurality of nozzles being oriented to provide thrust in a direction away from the position of a passenger standing on the top surface; and at least one protective projection that extends downwardly from the bottom surface of the platform to form a support structure that is located forward and aft of the nozzles, relative to the direction in which a passenger faces when standing on the platform, and that prevents contact between the nozzles of the thrust unit and non-fluid elements during take-off and landing of the propulsion device.

11. The propulsion device according to claim 10, further comprising a fluid collector and distributor that supplies pressurized fluid to the nozzles, and that is configured to connect a supply channel to the propulsion device.

12. The propulsion device according to claim 11, wherein the fluid collector and distributor comprises a base to which a supply channel is connected, enabling free rotation of the supply channel about an axis substantially parallel to that of the channel.

13. The propulsion device according to claim 12, wherein the fluid collector and distributor comprises arms respectively engaged with the nozzles to supply the nozzles with a pressurized fluid collected from the base and to allow free rotation about an axis substantially parallel to that of said arms.

* * * * *